US010830012B2

(12) United States Patent
Holmes et al.

(10) Patent No.: US 10,830,012 B2
(45) Date of Patent: Nov. 10, 2020

(54) INTELLIGENT WELL SYSTEM

(71) Applicants: Kevin Holmes, Houston, TX (US); Pavel Nazarenko, Houston, TX (US); Jason M. Harper, Houston, TX (US)

(72) Inventors: Kevin Holmes, Houston, TX (US); Pavel Nazarenko, Houston, TX (US); Jason M. Harper, Houston, TX (US)

(73) Assignee: BAKER HUGES, A GE COMPANY, LLC, Houston, TX (US)

( * ) Notice: Subject to any disclaimer, the term of this patent is extended or adjusted under 35 U.S.C. 154(b) by 147 days.

(21) Appl. No.: 16/106,556

(22) Filed: Aug. 21, 2018

(65) Prior Publication Data

US 2019/0128109 A1 May 2, 2019

Related U.S. Application Data

(60) Provisional application No. 62/580,682, filed on Nov. 2, 2017.

(51) Int. Cl.

| | |
|---|---|
| ***E21B 23/03*** | (2006.01) |
| ***E21B 47/01*** | (2012.01) |
| ***E21B 17/00*** | (2006.01) |
| ***E21B 47/12*** | (2012.01) |
| ***E21B 41/00*** | (2006.01) |
| ***E21B 34/06*** | (2006.01) |
| ***E21B 23/02*** | (2006.01) |
| ***E21B 34/10*** | (2006.01) |
| ***E21B 43/12*** | (2006.01) |
| ***E21B 17/02*** | (2006.01) |

(52) U.S. Cl.

CPC ..... *E21B 23/03* (2013.01); *E21B 17/003* (2013.01); *E21B 17/025* (2013.01); *E21B 23/02* (2013.01); *E21B 34/066* (2013.01); *E21B 34/105* (2013.01); *E21B 41/0035* (2013.01); *E21B 41/0085* (2013.01); *E21B 43/123* (2013.01); *E21B 47/01* (2013.01); *E21B 47/12* (2013.01)

(58) Field of Classification Search

CPC ..... E21B 23/03; E21B 23/02; E21B 17/025; E21B 34/066; E21B 34/105; E21B 41/0035; E21B 43/123

See application file for complete search history.

(56) References Cited

U.S. PATENT DOCUMENTS

| | | | | |
|---|---|---|---|---|
| 4,105,279 | A * | 8/1978 | Glotin | E21B 17/028 166/117.5 |
| 5,597,042 | A * | 1/1997 | Tubel | E21B 23/03 166/113 |
| 5,803,167 | A | 9/1998 | Bussear et al. | |
| 2003/0159823 | A1 | 8/2003 | Pichery et al. | |
| 2003/0164240 | A1 * | 9/2003 | Vinegar | E21B 17/003 166/372 |

(Continued)

OTHER PUBLICATIONS

International Search Report and Written Opinion for International Application No. PCT/US2018/058709; International Filing Date Nov. 1, 2018; Report dated Feb. 20, 2019 (pp. 1-9).

*Primary Examiner* — Tara Schimpf
(74) *Attorney, Agent, or Firm* — Cantor Colburn LLP

(57) ABSTRACT

A tubular system includes a side pocket mandrel having at least one side pocket defining a device storage zone. A conductor extends along the tubular system to the side pocket. A stored device is arranged in the device storage zone.

12 Claims, 4 Drawing Sheets

(56) References Cited

U.S. PATENT DOCUMENTS

| | | | | |
|---|---|---|---|---|
| 2006/0124310 | A1* | 6/2006 | Lopez de Cardenas | E21B 43/08 166/313 |
| 2013/0175049 | A1* | 7/2013 | Reaux | E21B 23/03 166/381 |
| 2014/0069639 | A1 | 3/2014 | Mackenzie et al. | |
| 2014/0126331 | A1 | 5/2014 | Skinner | |
| 2015/0000932 | A1 | 1/2015 | O'Brien | |

* cited by examiner

INTELLIGENT WELL SYSTEM

CROSS REFERENCE TO RELATED APPLICATIONS

This application claims the benefit of an earlier filing date from U.S. Provisional Application Ser. No. 62/580,682 filed Nov. 2, 2017, the entire disclosure of which is incorporated herein by reference.

BACKGROUND

In the resource exploration and recovery industry, tubulars are introduced into a wellbore for the purpose of drilling, completion work, introducing fluids, and recovering fluids as well as various other operations. In many cases, the wellbore may be separated into various zones through the use of isolation devices such as packers. The cost of exploration, and development of a wellbore is high. Accordingly, in order to remain profitable, wellbores may be in use and producing for 5-10 or more years.

Often times, one or more of the tubulars may include various devices such as control elements, controlled elements, sensors and the like. Devices arranged downhole from a packer are typically irretrievable. Other devices may be retrievable through a lengthy and costly reconfiguration operation. It is desirable that devices introduced and used downhole endure for the lifetime of the wellbore or should be replaceable/repairable.

Accordingly, devices arranged downhole from packets are subjected to a lengthy testing process prior to deployment. Other devices are likewise tested but may not need to be as robust as below packer devices. As the lifetime of a wellbore increases, the costs associated with developing, testing, and deploying wellbore devices increases in kind. Accordingly, the art would be receptive to systems that enable the deployment, replacement, repair and access to downhole devices, particularly those arranged downhole of a wellbore isolation device.

SUMMARY

Disclosed is a tubular system including a side pocket mandrel including at least one side pocket defining a device storage zone, a conductor extending along the tubular system to the side pocket, and a stored device arranged in the device storage zone.

The following descriptions should not be considered limiting in any way. With reference to the accompanying drawings, like elements are numbered alike:

DETAILED DESCRIPTION

A detailed description of one or more embodiments of the disclosed apparatus and method are presented herein by way of exemplification and not limitation with reference to the Figures.

Figure 1:
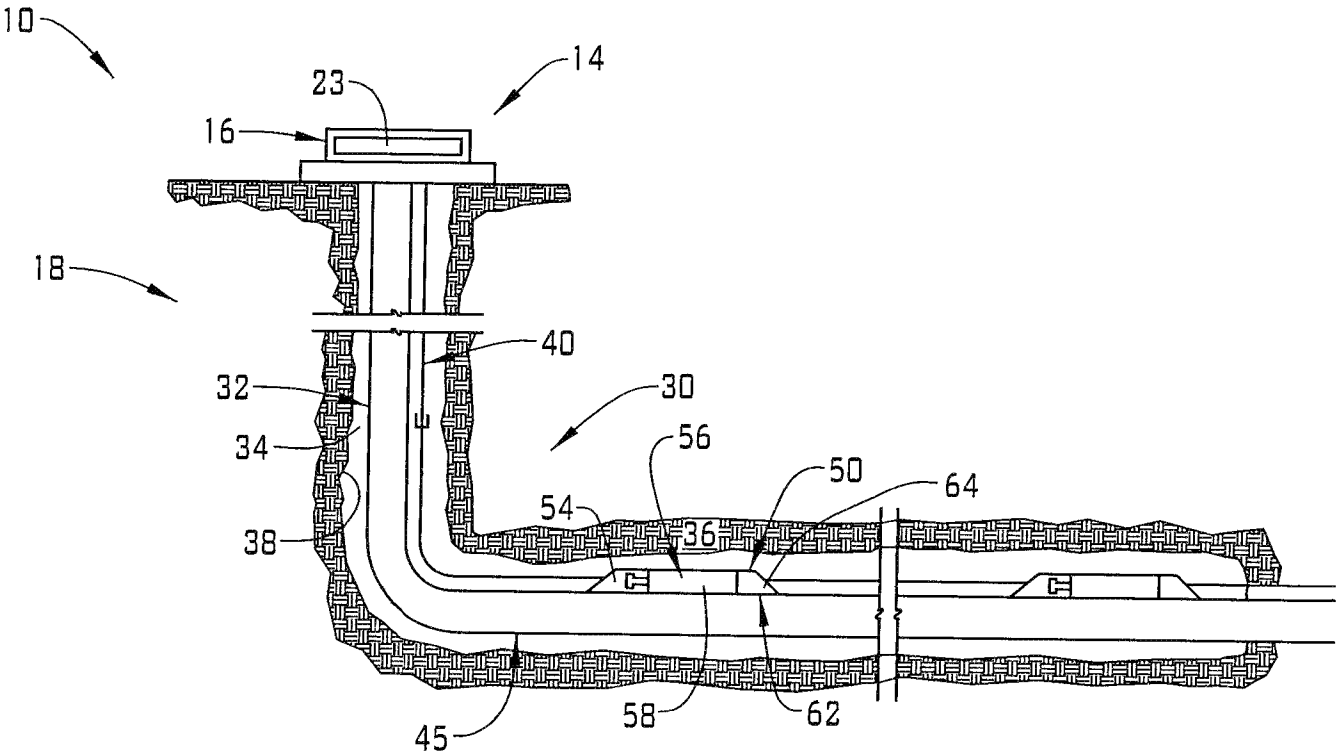
FIG. 1 depicts a resource exploration and recovery system including an intelligent well system, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations as will be discussed herein.

Second system 18 may include a tubular string 30 formed from a plurality of tubulars, one of which is indicated at 32 that is extended into a wellbore 34 formed in formation 36. A power and/or communications line 40 extends from first system 14 into second system 18 and connects with various downhole components as will be detailed herein. Power and/or communications line 40 may include a connector 44 arranged in wellbore 34.

In accordance with an aspect of an exemplary embodiment, second system 18 includes a side pocket mandrel 45 having a side pocket 50. Side pocket 50 defines a device storage zone 54 in which is arranged a stored device 56. A stored device should be understood to describe an in-active device 58 that is being held in device storage zone 54 until needed. For example, stored device 56 can take the form of a replacement valve, a replacement power source, a replacement communications component, a sensor, an electrical storage device, or the like. Side pocket 50 may include an address member 62 that could take the form of a radio frequency identification (RFID) chip 64 that enables location of device storage zone 54 from first system 14.

In accordance with an aspect of an exemplary embodiment, stored device 56 may be electrically connected to power and/or communications line 40. For example, when needed power may be passed to stored device 56 to charge an electrical storage device such as a battery, to test a valve, to test a circuit or the like. Functionality of and/or feedback from stored device 56 may be passed back to first system 14 via power and/or communications line 40. When ready, a tool may be guided to device storage zone 54 based on address member 62, accessed, and utilized to repair and/or replace a faulty device arranged along tubular string 30. In this manner, a device may be stored downhole of, for example, a packer, and allowed to lay dormant until needed. It should be appreciated that in addition to energy storage devices, side pocket 50 may contain an energy generation device and/or an energy harvesting device.

Figure 2:
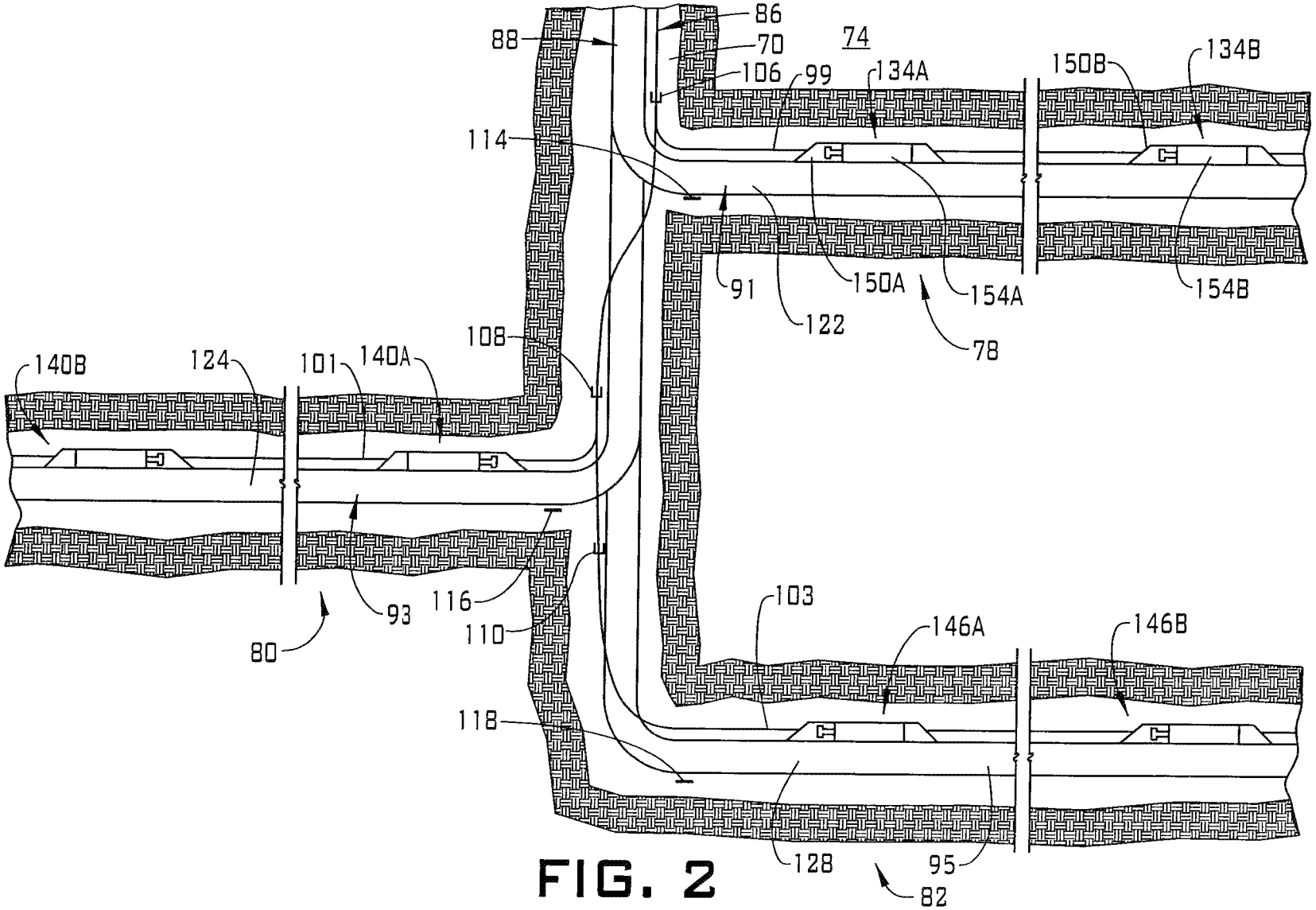
FIG. 2 depicts a downhole portion of the intelligent well system, in accordance with an aspect of an exemplary embodiment.
Figure 3:
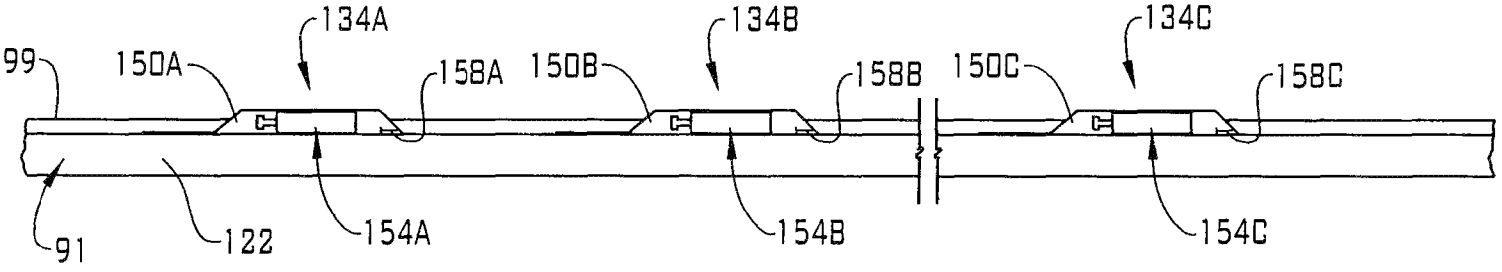
FIG. 3 depicts a tubular string of the intelligent well system, in accordance with an aspect of an exemplary embodiment.

Referencing FIGS. 2 and 3, a wellbore 70 extends into a formation 74. Wellbore 70 includes a first lateral bore 78, a second lateral bore 80 and a third lateral bore 82. It should be understood that the number and orientation of lateral bores may vary. A power and/or communications line 86 extends from first system 14 along a tubular string 88.

Tubular string 88 includes a first branch tubular 91 extending into first lateral bore 78, a second branch tubular 93 extending into second lateral bore 80 and a third branch tubular 95 extending into third lateral bore 82.

Power and/or communications line 86 includes a first branch line 99 extending along first branch tubular 91, a second branch line 101 extending along second branch tubular 93 and a third branch line 103 extending along third branch tubular 95. First, second and third branch lines 99, 101, and 103 are coupled to power and/or communications line 86 through a corresponding first connector 106, a second connector 108 and a third connector 110. First branch tubular 91 may include a first address member 114, second branch tubular 93 may include a second address member 116 and third branch tubular 95 may include a third address member 118.

In the exemplary embodiment shown, first branch tubular 91 includes a first side pocket mandrel 122, second branch tubular 93 includes a second side pocket mandrel 124 and third branch tubular 95 includes a third side pocket mandrel 128. First side pocket mandrel 122 includes a first side pocket 134A, a second side pocket 134B and a third side pocket 134C (FIG. 3). Second side pocket mandrel 124 includes a first side pocket 140A, and a second side pocket 140B, and third side pocket mandrel 128 includes a first side pocket 146A and a second side pocket 146B the number and arrangement of side pockets may vary.

In an embodiment, first side pocket 134A, second side pocket 134B, and third side pocket 134C may each contain separate devices that form part of an overall system. For example, first side pocket 134A may contain motor and/or choke portions of a valve; second pocket 134B may contain power and/or communications devices for the valve; and third side pocket 134C may contain sensors associated with the valve. The number, type, and position of the pockets and devices contained therein may vary. Further, the term "sensor" should be understood to include wireless transmitters, wireless repeaters or other wireless communication devices that may communicate with devices associated with tubular string 88, first system 14, and or systems that may be located in adjacent wellbores.

Referring to FIG. 3, wherein like reference numbers represent corresponding parts in the respective views, first side pocket 134A includes a first device storage zone 150A, second side pocket 134B includes a second device storage zone 150B and third storage pocket 134C includes a third device storage zone 150C. A first stored device 154A is arranged in first device storage zone 150A, a second stored device 154B is arranged in second device storage zone 150B, and a third stored device 154C is arranged in third device storage zone 150C. Devices 154A-154C may functionally connect with first branch line 99.

First device storage zone 150A may include a first address member 158A, second device storage zone 150B may include a second address member 158B, and third device storage zone 150C may include a third address member 158C. First, second, and third devices 154A-C may form part of a single assembly, or may be independent components that could be employed downhole.

Figure 4:
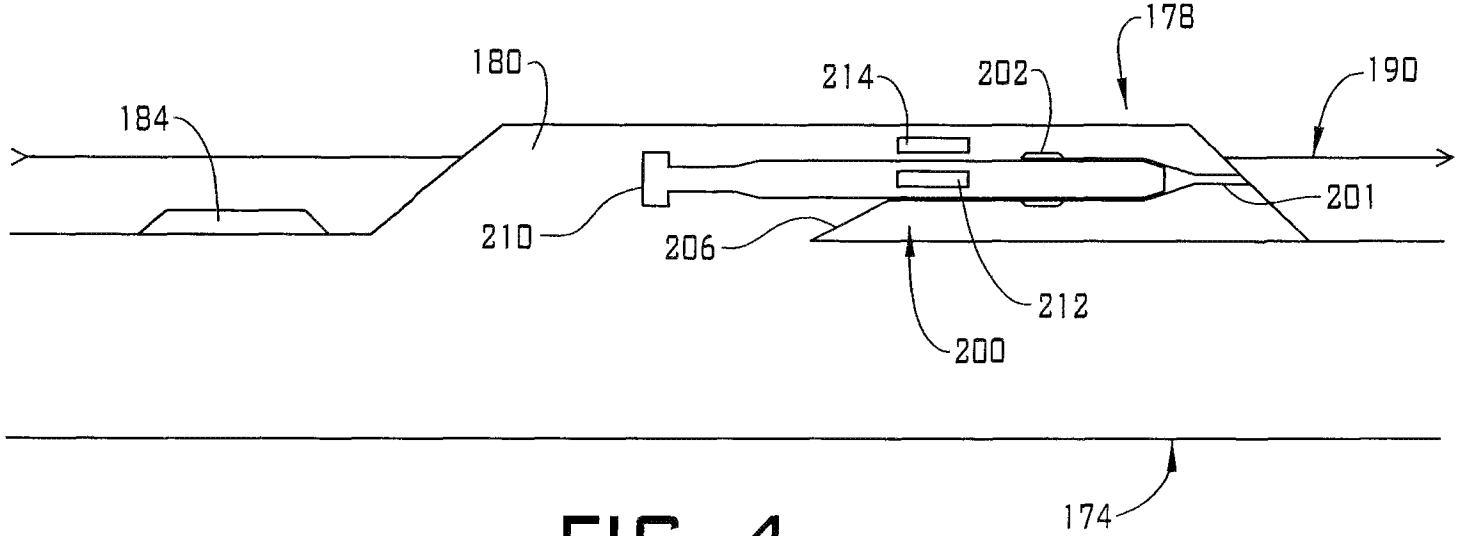
FIG. 4 depicts a tool storage area and tool of the intelligent well system, in accordance with an aspect of an exemplary embodiment.

Reference will now follow to FIG. 4 in describing a side pocket mandrel 174 in accordance with another exemplary aspect. Side pocket mandrel 174 includes a side pocket 178 having a device storage zone 180. An address member 184 is associated with side pocket 178 allowing for location identification as discussed above. A power and/or communication line 190 extends alongside and may functionally connect with device storage zone 180. A tool 200 may be arranged in device storage zone 180. Tool 200 may be arranged in an annulus 201 and retained through a latch mechanism 202. Annulus 201 may include a bevel 206 that promotes egress and ingress of tool 200 out from and into device storage zone 180.

Tool 200 may include an activator or manipulator 210 that may be employed in first branch tubular 91 to activate a valve, sliding sleeve or the like. Tool 200 may include a contactless power and communication link 212 that may functionally interact with a contactless power and communication dock 214 arranged in device storage zone 180. Tool 200 may be accessed from first system 14 via power and/or communication line 86 and activator/manipulator 210 commanded to take on repairs to various devices and/or systems arranged downhole.

Figure 5:
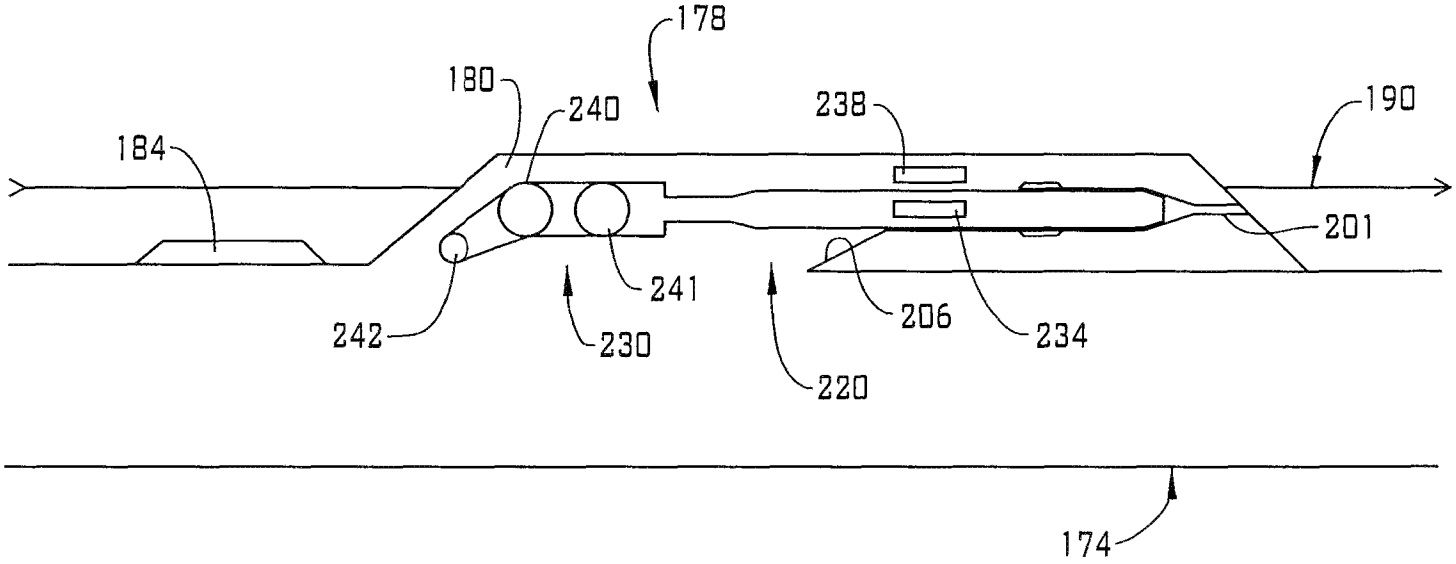
FIG. 5 depicts a tool including a manipulator arm in a tool storage area of an intelligent well system, in accordance with an aspect of an exemplary embodiment.

Reference will now follow to FIG. 5, wherein like reference numbers represent corresponding parts in the respective views, in describing a tool 220 in accordance with another exemplary aspect. Tool 220 includes a manipulating arm 230 and a power and/or communication link 234 that may functionally interact with contactless power and/or communication dock 214. Manipulating arm 230 may include a number of articulating joints 241, 242 and 243 that promote flexibility and enhance operational effectiveness. Tool 220 may be operated from first system 14 to carry out repair, maintenance and/or assembly operations downhole. The ability to repair and/or maintain tools downhole, particularly those that may be arranged downhole of a packer, will reduce the amount of pre-deployment testing needed thereby allowing for more rapid fielding of devices and/or systems. Additionally, pockets may be sent downhole empty and used for future storage or sent downhole with systems or devices that may later be deployed for operations. Further, it should be understood that various pockets may contain different parts and/or components of a single system.

Set forth below are some embodiments of the foregoing disclosure:

Embodiment 1

A tubular system comprising a side pocket mandrel including at least one side pocket defining a device storage zone, a conductor extending along the tubular system to the side pocket, and a stored device arranged in the device storage zone.

Embodiment 2

The tubular system according to any prior embodiment, wherein the stored device is electrically connected to the conductor.

Embodiment 3

The tubular system according to any prior embodiment, wherein the conductor provides communication and power to the device storage zone.

Embodiment 4

The tubular system according to any prior embodiment, wherein the stored device comprises an electrical storage device.

Embodiment 5

The tubular system according to any prior embodiment, wherein the stored device comprises a sensor.

Embodiment 6

The tubular system according to any prior embodiment, wherein the stored device comprises a tool.

Embodiment 7

The tubular system according to any prior embodiment, wherein the tool includes a manipulator.

Embodiment 8

The tubular system according to any prior embodiment, where the stored device comprises one of an energy generating device.

Embodiment 9

The tubular system according to any prior embodiment, further comprising an address member arranged at the side pocket, the address member identifying the device storage zone.

Embodiment 10

The tubular system according to any prior embodiment, wherein the at least one pocket includes a first pocket and a second pocket, the first pocket including a first device storage zone and the second pocket including a second device storage zone.

Embodiment 11

The tubular system according to any prior embodiment, wherein the stored device is arranged in the first storage zone and another stored device is arranged in the second device storage zone.

Embodiment 12

The tubular system according to any prior embodiment, wherein the first stored device forms a first part of a system and the another stored device forms another part of the system.

Embodiment 13

The tubular system according to any prior embodiment, wherein the stored device comprises one of a valve motor and a valve choke and the another stored device comprises one of a valve communication device and a sensor associated with the valve.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A tubular system comprising:

a side pocket mandrel including at least one side pocket defining a device storage zone;

a conductor extending along the tubular system to the side pocket;

an address member including an electronic identification device arranged at the side pocket in the side pocket mandrel, the address member configured to provide remote identification of the device storage zone; and a stored device arranged in the device storage zone.

2. The tubular system according to claim 1, wherein the stored device is electrically connected to the conductor.

3. The tubular system according to claim 2, wherein the conductor provides communication and power to the device storage zone.

4. The tubular system according to claim 2, wherein the stored device comprises an electrical storage device.

5. The tubular system according to claim 2, wherein the stored device comprises a sensor.

6. The tubular system according to claim 2, wherein the stored device comprises a tool.

7. The tubular system according to claim 6, wherein the tool includes a manipulator.

8. The tubular system according to claim 2, wherein the stored device comprises one of an energy harvesting and an energy generating device.

9. The tubular system according to claim 1, wherein the at least one pocket includes a first pocket and a second pocket, the first pocket including a first device storage zone and the second pocket including a second device storage zone.

10. The tubular system according to claim 9, wherein the stored device is arranged in the first storage zone and another stored device is arranged in the second device storage zone.

11. The tubular system according to claim 10, wherein the first stored device forms a first part of a system and the another stored device forms another part of the system.

12. The tubular system according to claim 11, wherein the stored device comprises one of a valve motor and a valve choke and the another stored device comprises one of a valve communication device and a sensor associated with a valve connected to the tubular system.

* * * * *